US007942235B2

(12) United States Patent
Mirlach et al.

(10) Patent No.: US 7,942,235 B2
(45) Date of Patent: May 17, 2011

(54) EXHAUST SYSTEM FOR AN INTERNAL COMBUSTION ENGINE

(75) Inventors: Robert Mirlach, Gauting (DE); Bjoern Koch, Neuweiler-Breitenberg (DE)

(73) Assignees: Bayerische Motorenwerke Aktiengesellschaft, Altensteig (DE); Friedrich Boysen GmbH, Neuweiler-Breitenberg (DE)

( * ) Notice: Subject to any disclaimer, the term of this patent is extended or adjusted under 35 U.S.C. 154(b) by 521 days.

(21) Appl. No.: 10/574,389

(22) PCT Filed: Sep. 10, 2004

(86) PCT No.: PCT/EP2004/010109

§ 371 (c)(1),
(2), (4) Date: Apr. 12, 2007

(87) PCT Pub. No.: WO2005/033485

PCT Pub. Date: Apr. 14, 2005

(65) Prior Publication Data

US 2007/0272479 A1 Nov. 29, 2007

(30) Foreign Application Priority Data

Oct. 2, 2003 (DE) ..... 103 46 479

(51) Int. Cl.
*F01N 1/02* (2006.01)

(52) U.S. Cl. ..... 181/251; 181/227; 181/228; 181/249

(58) Field of Classification Search ..... 181/227, 181/228, 238, 257, 268, 249, 248, 247, 212
See application file for complete search history.

(56) References Cited

U.S. PATENT DOCUMENTS

| | | | | |
|---|---|---|---|---|
| 3,388,770 | A * | 6/1968 | Straw | 181/228 |
| 6,135,237 | A * | 10/2000 | Allman | 181/282 |
| 6,382,347 | B1 * | 5/2002 | Gerber | 181/227 |
| 6,571,911 | B2 * | 6/2003 | Watanabe et al. | 181/265 |
| 6,598,390 | B2 * | 7/2003 | Chang | 60/323 |
| 6,644,437 | B1 * | 11/2003 | Hayman | 181/268 |
| 6,651,773 | B1 * | 11/2003 | Marocco | 181/270 |
| 6,662,900 | B2 * | 12/2003 | Cathcart et al. | 181/240 |
| 6,755,279 | B2 * | 6/2004 | Kaneko et al. | 181/232 |
| 6,935,461 | B2 * | 8/2005 | Marocco | 181/270 |
| 6,938,729 | B2 * | 9/2005 | Worner et al. | 181/254 |
| 6,942,061 | B2 * | 9/2005 | Butterfield et al. | 181/275 |
| 7,004,283 | B2 * | 2/2006 | Worner et al. | 181/239 |
| 7,287,622 | B2 * | 10/2007 | Rauch et al. | 181/272 |
| 7,377,359 | B2 * | 5/2008 | Hofmann et al. | 181/275 |
| 7,380,635 | B2 * | 6/2008 | Harris | 181/206 |
| 7,380,637 | B2 * | 6/2008 | Sieben et al. | 181/240 |
| 7,416,052 | B2 * | 8/2008 | Mabuchi et al. | 181/272 |
| 7,503,427 | B2 * | 3/2009 | Toyoshima | 181/272 |
| 2001/0018995 | A1 * | 9/2001 | Uegane | 181/275 |
| 2001/0045322 | A1 * | 11/2001 | Nilsson et al. | 181/227 |

(Continued)

FOREIGN PATENT DOCUMENTS

DE 4217630 A1 9/1993

(Continued)

*Primary Examiner* — Elvin G Enad
*Assistant Examiner* — Forrest M Phillips
(74) *Attorney, Agent, or Firm* — Kilpatrick Townsend & Stockton LLP

(57) ABSTRACT

Disclosed is an exhaust system (100) for an internal combustion engine, comprising a first exhaust train that is provided with a penetrable first muffler (120), especially a rear muffler, and at least one second exhaust train which encompasses a second penetrable muffler (122), particularly a rear muffler. The structure of the first muffler (120) differs from that of the second muffler (122).

11 Claims, 3 Drawing Sheets

U.S. PATENT DOCUMENTS

2006/0162995 A1 * 7/2006 Schorn et al. ..... 181/237

FOREIGN PATENT DOCUMENTS

DE 19728243 A1 1/1998
DE 19743446 A1 12/1998
DE 10146507 A1 6/2002
DE 20200754 U1 6/2002
EP 0682172 B1 6/1998
JP 03067012 A * 3/1991
JP 05106432 A * 4/1993

* cited by examiner

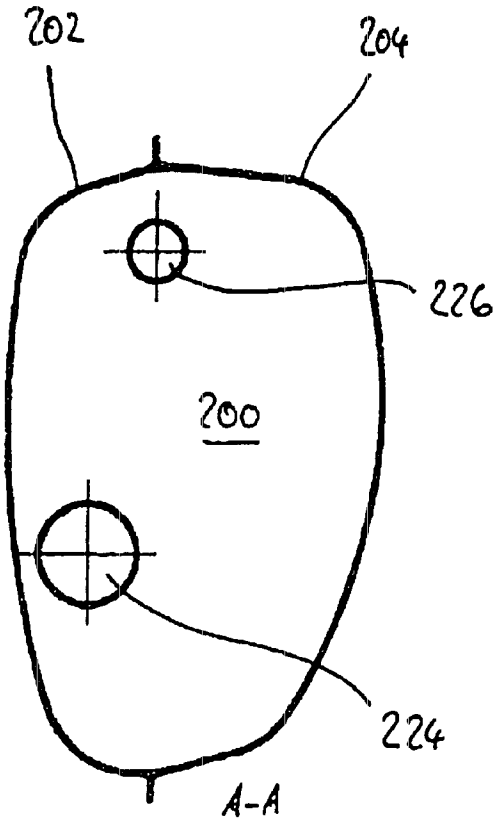
Fig. 2
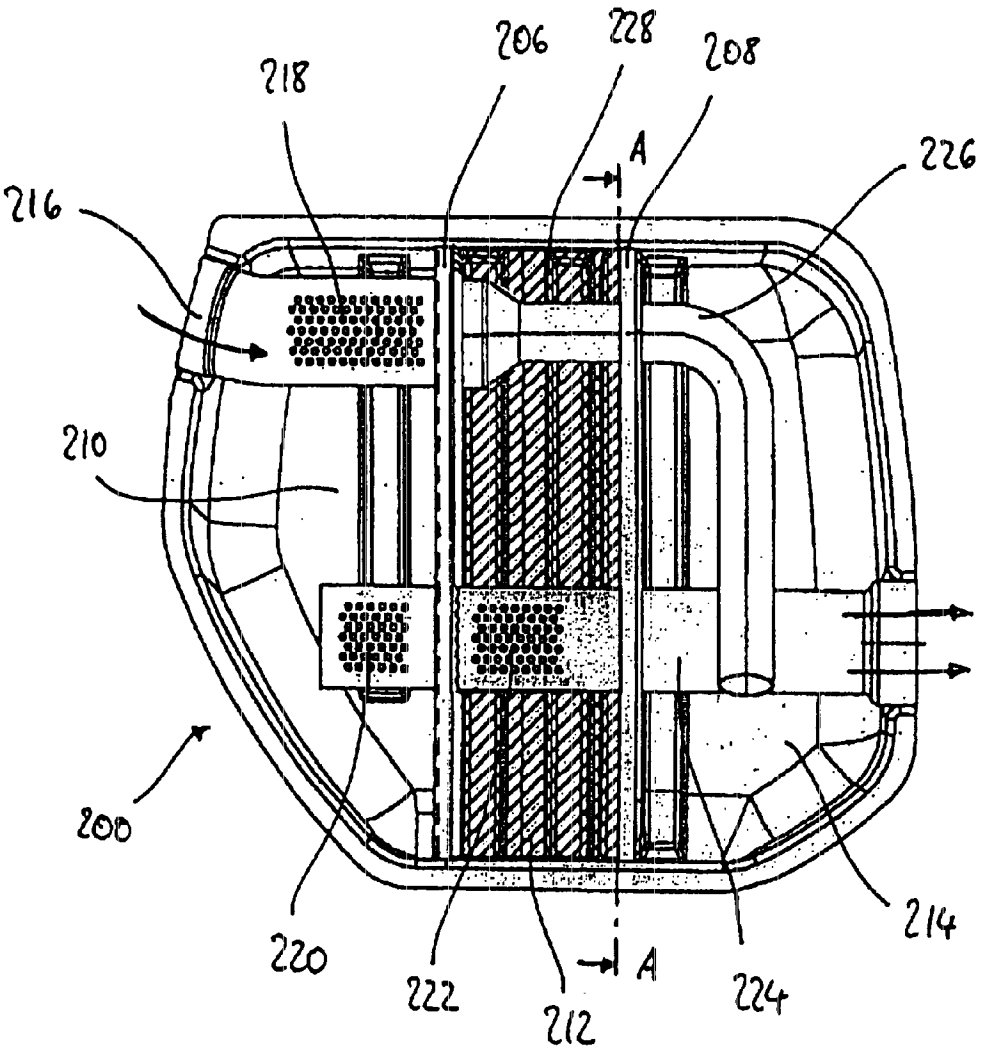

EXHAUST SYSTEM FOR AN INTERNAL COMBUSTION ENGINE

CROSS-REFERENCE TO RELATED APPLICATIONS

This application is a National Stage of International Application No. PCT/EP2004/010109), filed Sep. 10, 2004, and which claims priority to German Patent Application No. 103 46 479.4, filed Oct. 2, 2003. The disclosures of these applications are incorporated herein by reference.

FIELD OF THE INVENTION

The invention relates to an exhaust system for an internal combustion engine comprising a first exhaust train including a flow-permeable first muffler, in particular a rear muffler, and at least one second exhaust train parallel thereto and including a flow-permeable second muffler, in particular a rear muffler, wherein the first muffler and the second muffler have a mutually deviating structure.

BACKGROUND OF THE INVENTION

Exhaust systems of this type are in particular used in series production in motor vehicles to influence the noise emission of the internal combustion engine. DE 197 43 446 A1, for example, describes an exhaust system for an internal combustion engine which ensures good sound absorption over the whole frequency range with respect to a reduced noise level of motor vehicle engines and nevertheless does not allow the exhaust pressure to increase too highly even at a high internal combustion engine speed. For this purpose, two parallel mufflers are provided which are tuned to different frequencies. Both mufflers are operable as flow-permeated reflection mufflers, on the one hand; on the other hand, a discharge of the exhaust flow from the muffler can be prevented by closing the outlet pipe of a muffler by means of an exhaust flap so that it then acts as a Helmholtz resonator.

The exhaust system described by DE 197 43 446 A1 comprises an exhaust train which is made in parallel sectionally. In accordance with the embodiments, the exhaust flow is supplied to the two mufflers at the inlet side via a common forking exhaust pipe and/or is merged and led away via a common exhaust pipe at the outset side or, respectively, a double-fork-like double junction is provided as a cross-position.

With an arrangement of this type, the typical sound of an internal combustion engine comprising at least two cylinder banks, such as a V8, is disadvantageously lost. In particular, the vibrations of odd orders are lost; the ignition order (4th order of vibrations) and its harmonic dominate. Attributes such as force and power can only be represented by volume so that a conflict is present in this respect with the comfort demand made on the drive.

The crankshaft of multi-cylinder internal combustion engines is produced by arranging the crank throws of the individual cylinders in rows next to one another. When fixing the throw sequence, it is important to observe an ignition sequence which is as smooth as possible, a mass balancing and the rotary oscillations. The changing cylinder pressures which act on the exhaust system in dependence on the throw sequence and on the ignition sequence via the outer structure-borne route make a decisive contribution to the characteristic sound of the internal combustion engine.

With V8 internal combustion engines, for example, a customary ignition sequence is 1-5-4-8-6-3-7-2, with the cylinders 1-4 being associated with one cylinder bank and the cylinders 5-8 being associated with the other cylinder bank. On the basis of this ignition sequence, significant frequency proportions arise in the oscillations of odd orders since, for example, 270° crankshaft lie between cylinders four and three on the one cylinder bank and only 90° crankshaft between cylinders two and one. The excitation spectra on the exhaust side of both cylinder banks are in turn identical, but phase shifted, to one another.

SUMMARY OF THE INVENTION

It is the object of the invention to provide an initially named exhaust system by means of which the typically forceful and powerful sound of an internal combustion engine with a plurality of cylinder banks, such as a V8 internal combustion engine, can be represented without excessive volume and thus while satisfying a high comfort demand. The significant frequency portions in the oscillations of odd orders should in particular be maintained.

The object is satisfied by the claimed features wherein, the first muffler comprises an inlet pipe and an outlet pipe, with the outlet pipe having a small length, and the second muffler comprises an inlet pipe and an outlet pipe, with the outlet pipe having a large length. "Small length" and "large length" in this context relate primarily to the ratio of the lengths among one another, with one length being much larger than the other. In this process, the acoustically effective length, which is determined by the place of exhaust inlet and outlet, is decisive.

Advantageous embodiments and further developments are the subject matter of the dependent claims.

It is of particular advantage for the outlet pipe of the first muffler to have at least approximately twice the length of the outlet pipe of the second muffler.

Expediently, the outlet pipe of the second muffler has an at least slightly larger diameter than the outlet pipe of the first muffler so that back pressure differences due to the longer outlet pipe are avoided.

In accordance with a particularly preferred embodiment, the first muffler has an internal structure which is divided into three part spaces by means of two metal separating sheets, with the first metal separating sheet being perforated and the second metal separating sheet being intact. An exchange of gas between the first and second part spaces is possible through the separating wall; the separating wall to the third part space is sealingly closed. The inlet pipe of the first muffler expediently opens into the first part space at the inlet side. The outlet pipe advantageously leads through the second and third part spaces, starting from the first part space on the inlet side, with the outlet pipe being able to be acted on by flow both from the first part space and from the first parts space through the second part space. The use of a resonator adjoining the inlet pipe and extending into the second and third part spaces has proved to be very advantageous.

Pursuant to the particularly preferred embodiment, the second muffler has an internal structure divided into three part spaces by means of two metal separating sheets, with the first metal separating sheet being intact and the second metal separating sheet being perforated. An exchange of gas between the second and third part spaces is possible through the separating wall; the separating wall to the first part space is sealingly closed. The inlet pipe of the second muffler expediently extends through the first and second part spaces at the inlet side and opens into the third part space. The outlet pipe advantageously leads through the second part space into the first part space on the inlet side, starting from the third part space, and back through the second and third part spaces in an arcuate curve, with the outlet pipe being able to be acted on by flow through the second part space, at the inlet side both from the third part space and from the third part space. The use of a resonator which connects the third part space to the first part space has proved to be very advantageous.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

An exemplary embodiment of the invention which is to be particularly preferred is explained in more detail in the following with reference to the Figures, wherein:

FIG. 2 illustrates a first rear muffler with a short outlet pipe; and

DETAILED DESCRIPTION OF THE PREFERRED EMBODIMENTS

The following description of the preferred embodiment is merely exemplary in nature and is in no way intended to limit the invention, its application, or uses.

Figure 1:
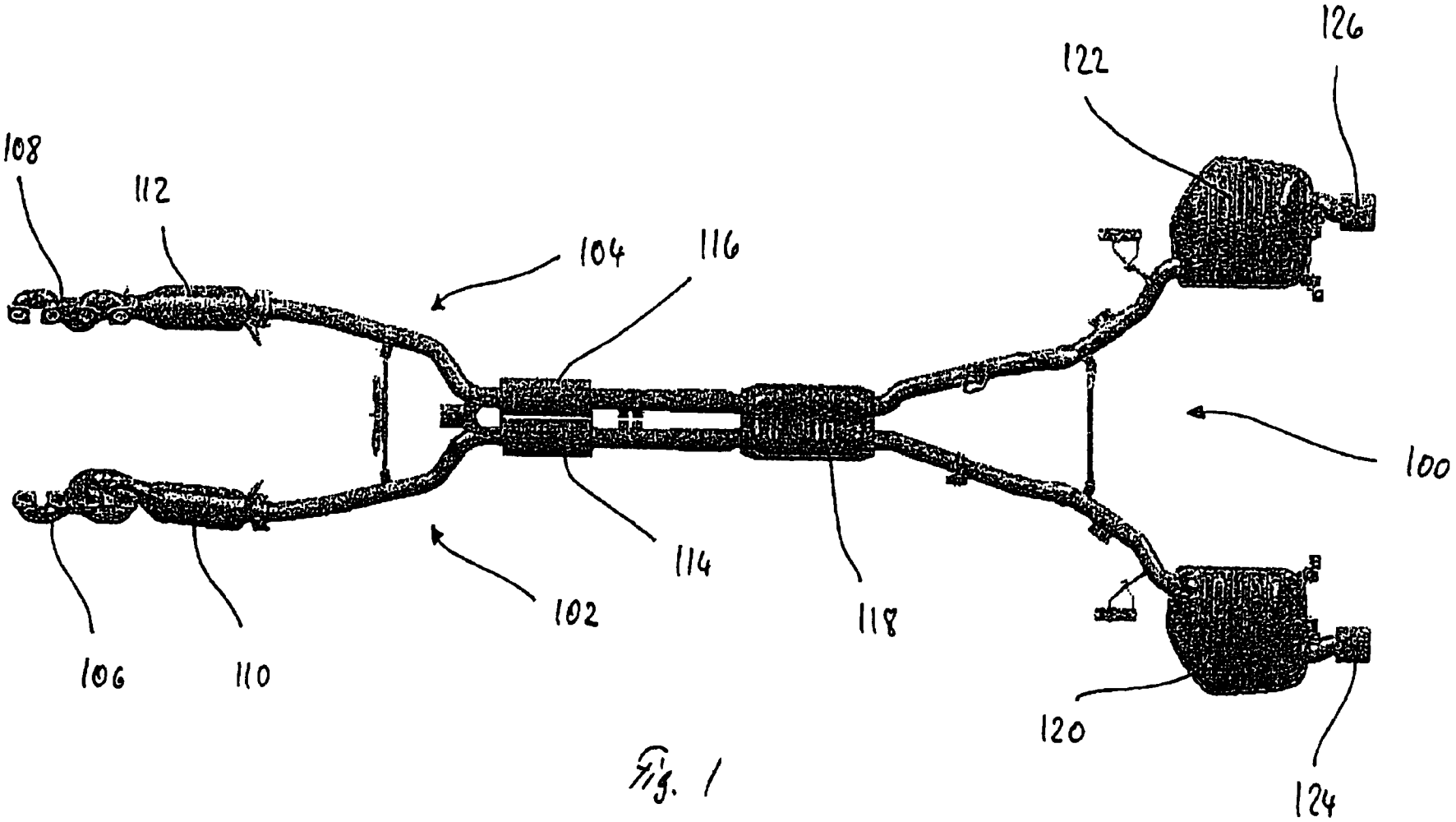
FIG. 1 illustrates a double-pass exhaust system for a V8 internal combustion engine with a rear muffler.

FIG. 1 shows a double-pass exhaust system 100 comprising a first exhaust train 102 and a second exhaust train 104 for a V8 internal combustion engine not shown in more detail here. The internal combustion engine comprises two banks with four cylinders each, with a first cylinder bank being formed with the cylinders one to four and a second cylinder bank being formed with the cylinders five to eight. In operation of the internal combustion engine, ignition takes place in the order 1-5-4-8-6-3-7-2. The outlets of the first cylinder bank open into the manifold 106 of the first exhaust train 102; the outlets of the second cylinder bank open into the manifold 108 of the second exhaust train 104. Directly adjoining the manifolds 106, 108, each exhaust train 102, 104 comprises a catalytic converter 110, 112 close to the engine for post-treatment of the exhaust, with it being a case of conventional 3-way catalytic converters in the present case.

In the operation of the internal combustion engine, a changing cylinder pressure is generated by the periodic combustion processes in the cylinders and thus a (gas) oscillation is stimulated which can be perceived as sound. The sound in particular continues via the outer structure-borne route through the cylinder outlets and the whole exhaust system up to the tail pipes 124, 126. The sound is decisively influenced by the mufflers arranged in each exhaust train 102, 104. In the present case, each exhaust train 102, 104 comprises pre-mufflers 114, 116 made as absorptive attenuators and middle mufflers 118 as well as rear mufflers 124, 126.

The exhaust system 100 is made completely in a double pass design, substantially without cross-positions. It has, however, proved to be advantageous optionally to provide one or more minimal cross-positions so that a softer sound can be achieved without any real gas exchange and an adjustment can be made in this respect. In the present case, a minimal cross-position of this type is provided in the region of the middle muffler 118, with an internal separation taking place inside the common middle muffler 118. The front region of the middle muffler 118 is associated with the one exhaust train, the rear region with the other one.

The rear mufflers 124, 126 of the exhaust system 100, unlike the otherwise symmetrical structure of the exhaust system 100, have a different structure with the aim of achieving an amplification of the oscillations of odd orders in the distant field at the outside and in the inner noise by a change in the phase relationship of the individual openings. Details of the rear mufflers 124, 126 are shown and described in FIGS. 2 and 3.

The rear muffler 120 of the first exhaust train 102 is shown in two views in FIG. 2 and is designated by 200. The rear muffler 200 is formed in the manner of a pot from two half shells 202 and 204 which are sealingly connected to one another and enclose an inner space. The inner space is divided into three part spaces 210, 212 and 214 by a perforated separating wall 206 and an intact separating wall 208, with the part space 212 being filled with an absorptive material 228. The inlet pipe 216 opens into the first part space 210; a resonator 226 adjoins which extends through the second part space 212 into the third part space 214. The outlet pipe 224 extends from the first part space 210 through the second part space 212 and the third part space 214. The flow through the rear muffler 200 takes place starting from the inlet pipe 216 which opens via holes 218 into the first part space 210 via holes 220 in the outlet pipe 224, on the one hand, and through the perforated separating wall 206 and the second part space 212 via holes 222 in the outlet pipe 224, on the other hand.

Figure 3:
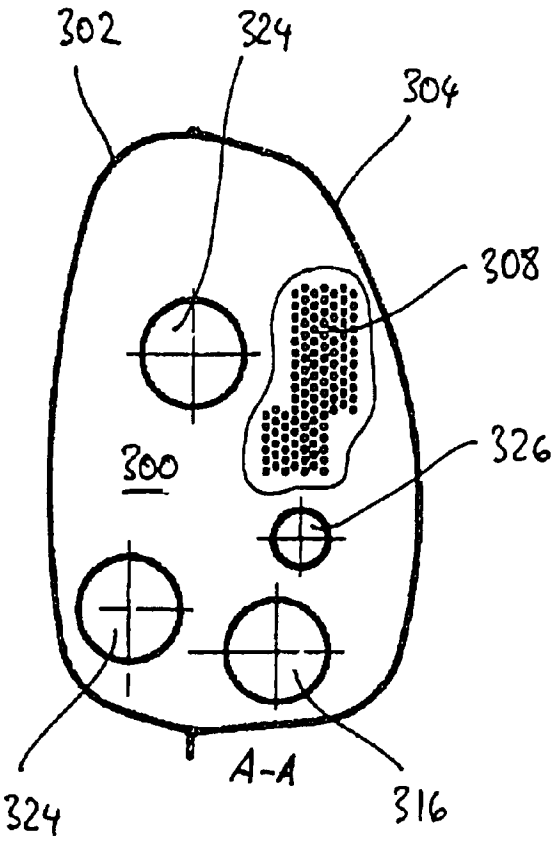
FIG. 3 illustrates a second rear muffler with a long outlet pipe.
Figure 3:
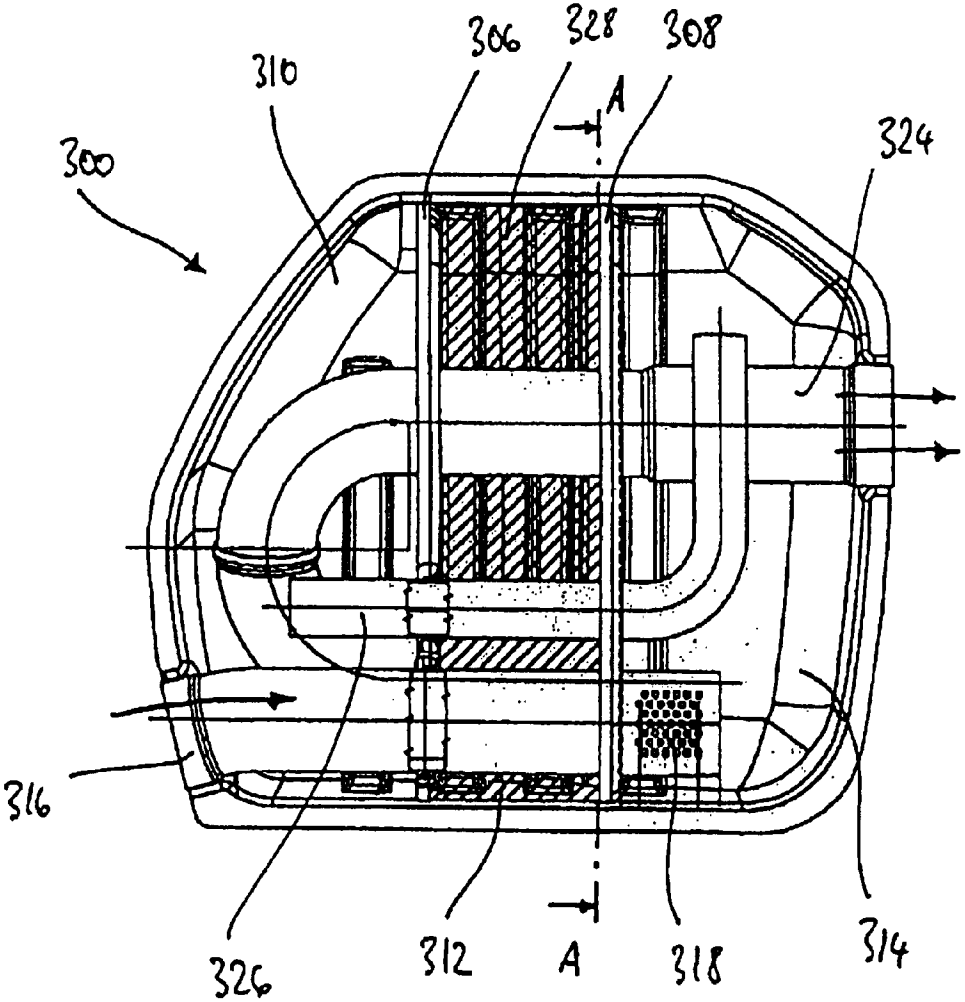

The rear muffler 122 of the second exhaust train 104 is shown in two views in FIG. 3 and is designated by 300. The rear muffler 300 is formed in the manner of a pot from two half shells 302 and 304 which are sealingly connected to one another and enclose an inner space. The inner space is divided into three part spaces 310, 312 and 314 by an intact separating wall 306 and an perforated separating wall 308, with the part space 312 being filled with an absorptive material 328. The inlet tube 316 extends through the first part space 310 and the second part space 312 and opens into the third part space 314. To achieve a softer transition, the pipe 316 open at the end is additionally provided with holes 318 in the end region. The outlet pipe 324 extends—masked by the inlet pipe 316 in the present view—from the third part space 314 through the second part space 312 into the first part space 310 and back in an arcuate curve through the second part space 312 and the third part space 314. The flow through the rear muffler 200 takes place starting from the inlet pipe 316 which opens into the third part space 314 through the outlet pipe 324, on the one hand, and through the perforated separating wall 308 and the second part space 312 via holes in the outlet pipe 324 not visible here, on the other hand. A resonator 326 connects the third part space 314 to the first part space 310.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. An exhaust system for an internal combustion engine, comprising:

a first exhaust train starting from a first cylinder bank and including a flow-permeable muffler; and at least one second exhaust train parallel thereto, starting from a second cylinder bank and including a flow-permeable second muffler, wherein the first muffler and the second muffler have a mutually deviating structure; and wherein the first and second cylinder banks form a portion of a V8 engine having a crankshaft, and wherein the first and second cylinder banks each have a pair of cylinders that are ignited within 90° or 270° of operation of the crankshaft to produce odd order gas oscillations, wherein the odd order gas oscillations of the first cylinder bank have a phase relationship with the odd order oscillations of the second cylinder bank;

wherein the first and second exhaust trains are guided over the whole length with substantially no cross-over; positions;

the first muffler comprises an inlet pipe and an outlet pipe;

the second muffler comprises an inlet pipe and an outlet pipe;

the outlet pipe of the first muffler has a comparatively small length with respect to the outlet pipe of the second muffler according to a ratio; and wherein the first and second mufflers reduce acoustic volume of the odd order gas oscillations of the first and second cylinder banks while the ratio of the outlet pipes allows the first and second mufflers to influence the phase relationship, and wherein the outlet pipe of the second muffler comprises a slightly larger diameter than the outlet pipe of the first muffler such that the first and second mufflers do not provide substantial back pressure differences to the first and second cylinder banks.

2. An exhaust system in accordance with claim 1, wherein the outlet pipe of the second muffler has at least approximately twice the length of the outlet pipe of the first muffler.

3. An exhaust system in accordance with claim 1, wherein the first muffler has an inner structure divided into three part spaces by means of two metal separating sheets, with the first metal separating sheet being perforated and the second metal separating sheet being intact.

4. An exhaust system in accordance with claim 3, wherein the input pipe opens into the first part space at the inlet side.

5. An exhaust system in accordance with claim 3, wherein the outlet pipe leads, starting from the first part space on the inlet side, through the second part space and the third part space, with the outlet pipe being able to be acted on by flow both from the first part space and from the first part space through the second part space.

6. An exhaust system in accordance with claim 3, further comprising a resonator extending through the second part space and into the third part space and adjoining the inlet pipe.

7. An exhaust system in accordance with claim 1, wherein the second muffler has an inner structure divided into three part spaces by means of two metal separating sheets, with the first metal separating sheet being intact and the second metal separating sheet being perforated.

8. An exhaust system in accordance with claim 7, wherein the inlet pipe extends through the first part space and through the second part space at the inlet side and opens into the third part space.

9. An exhaust system in accordance with claim 7, wherein the outlet pipe leads through the second part space into the first part space on the inlet side, starting from the third part space, and back through the second part space and the third part space in an arcuate curve, with the outlet pipe being able to be acted on by flow at the inlet side both from the third part space and from the third part space through the second part space.

10. An exhaust system in accordance with claim 7, wherein a resonator connects the third part space to the first part space.

11. An exhaust system in accordance with claim 6, wherein the resonator extends from an exit of the first inlet pipe.

* * * * *